US006746809B1

(12) United States Patent
Sato et al.

(10) Patent No.: US 6,746,809 B1
(45) Date of Patent: Jun. 8, 2004

(54) TONER FOR DEVELOPMENT OF ELECTROSTATIC IMAGE AND PRODUCTION PROCESS THEREOF

(75) Inventors: Kazuhiro Sato, Kanagawa (JP); Takeo Fujino, Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 10/031,646

(22) PCT Filed: May 8, 2000

(86) PCT No.: PCT/JP00/02925

§ 371 (c)(1),
(2), (4) Date: Jan. 7, 2002

(87) PCT Pub. No.: WO00/68741

PCT Pub. Date: Nov. 16, 2000

(30) Foreign Application Priority Data

May 7, 1999 (JP) ..... 11/127681

(51) Int. Cl.[7] ..... G03G 9/083
(52) U.S. Cl. ..... 430/110.2; 430/137.15; 430/111.4
(58) Field of Search ..... 430/110.2, 111.4, 430/137.15

(56) References Cited

U.S. PATENT DOCUMENTS 5,217,836 A * 6/1993 Takiguchi et al. ..... 430/111.4

FOREIGN PATENT DOCUMENTS

| | | |
|---|---|---|
| EP | 0947887 | 10/1999 |
| JP | 55155362 | 12/1980 |
| JP | 01217464 | 8/1989 |
| JP | 03015858 | 1/1991 |
| JP | 03175456 | 7/1991 |
| JP | 03243954 | 10/1991 |
| JP | 05080581 | 4/1993 |
| JP | 05100485 | 4/1993 |
| JP | 05127424 | 5/1993 |
| JP | 05289404 | 11/1993 |
| JP | 07092736 | 4/1995 |
| JP | 10207122 | 8/1998 |
| JP | 11015192 | 1/1999 |
| JP | 11344829 | 12/1999 |
| JP | 2000081725 | 2/2000 |

* cited by examiner

*Primary Examiner*—Mark A. Chapman
(74) *Attorney, Agent, or Firm*—Dinsmore & Shohl LLP

(57) ABSTRACT

A toner for development of electrostatic images which has a residual polymerizable monomer content lower than 70 ppm and is substantially spherical as demonstrated by the flowability of at least 55%, and a process for producing a toner reduced in residual polymerizable monomer content by subjecting a slurry containing polymer particles obtained by polymerization to a stripping treatment under reduced pressure.

22 Claims, No Drawings

TONER FOR DEVELOPMENT OF ELECTROSTATIC IMAGE AND PRODUCTION PROCESS THEREOF

TECHNICAL FIELD

The present invention relates to a toner for development of electrostatic images and a production process thereof, and more particularly to a toner for development of electrostatic images, which is extremely low in the content of residual polymerizable monomers and excellent in environmental safety and moreover flowability, and a production process thereof.

BACKGROUND ART

In an electrophotographic process, electrostatic recording process, electrostatic printing process or the like, a toner for development of electrostatic images (hereinafter referred to as "toner" merely) is used as a developer for developing an electrostatic latent image formed on a photosensitive member into a visible image. The toner is composed of colored resin particles containing at least a binder resin and a colorant, and additionally containing various kinds of additives such as a charge control agent and a parting agent as needed.

Processes for producing the toner are roughly divided into a grinding process and a polymerization process. The grinding process is a process of producing a toner (ground toner) by melting and kneading individual components such as a binder resin and a colorant, and then grinding and classifying the kneaded product. The polymerization process is a process of producing polymer particles (polymerized toner particles) by subjecting a polymerizable monomer composition containing a polymerizable monomer and a colorant, and optionally various kinds of additives such as a charge control agent and a parting agent to suspension polymerization. The colored polymer particles containing the colorant may be used as core particles to form a polymer layer (shell) on the surfaces thereof, thereby providing polymer particles of a core.shell structure. In the polymerization process, a suspension polymerization process is generally used. However, any other polymerization process such as an emulsion polymerization process may be adopted if desired. In the polymerized toner, the polymer component formed by the polymerization of the polymerizable monomer becomes a binder resin.

In any technique of the grinding process and the polymerization process, it is difficult to completely react the polymerizable monomer in the polymerization step for forming the binder resin. Therefore, it is unavoidable that an unreacted polymerizable monomer remains in the toner. When a toner in which a polymerizable monomer remains in a comparatively great amount is used in an image forming apparatus such as an electrophotographic copying machine or laser printer, the remaining polymerizable monomer is vaporized out of the toner by heating upon fixing of an image formed, or the like to worsen a working environment or emit unpleasant odor. The toner in which the polymerizable monomer remains in a comparatively great amount tends to undergo blocking during its storage or in a toner box of an image forming apparatus, thereby impairing the flowability of the toner. Further, when the toner in which the polymerizable monomer remains in a comparatively great amount is used, such disadvantages that an offset phenomenon occurs upon the fixing of an image formed, and filming on individual members in the image forming apparatus tends to occur.

In the grinding process, the residual polymerizable monomers can be removed from the binder resin formed with relative ease in advance in a post-treatment after the polymerization. Therefore, there is no possibility that the amount of the polymerizable monomer removed may be adversely affected by the additive components such as the colorant, or that the toner may aggregate in the removal step of the unreacted polymerizable monomer, since the binder resin can be melted and kneaded with the additives such as the colorant, charge control agent and parting agent after removing the residual polymerizable monomers from the binder resin, and the resulting mixture is ground, whereby a toner can be provided. However, any toner substantially spherical and sharp in particle diameter distribution can not be obtained by the grinding process.

On the other hand, in the case of the polymerized toner, the residual polymerizable monomers must be removed from the polymer particles containing the additives such as the colorant, charge control agent and parting agent. It is difficult to reduce the residual polymerizable monomers because the residual polymerizable monomers is easy to be adsorbed on these additives. In addition, when a removal method such as drying of the resulting polymerized toner under reduced pressure is adopted for the purpose of reducing the amount of the residual polymerizable monomers, disadvantages such as aggregation tends to occur.

According to the polymerization process, a toner substantially spherical and sharp in particle diameter distribution can be provided, thereby forming a high-quality image. In recent years, there has been a strong demand for meeting requirements such as provision of high definition images, energy saving, speeding-up of printing (including copying and recording), miniaturization of apparatus, formation of full-color images and the like. In order to meet these requirements, it is required to design a polymerized toner so as to make the average particle diameter of the resulting polymerized toner smaller than that of a generally used toner or make the fixing temperature thereof lower than before. When it is intended to meet these requirements against the polymerized toner, however, it is more and more difficult to reduce the amount of the residual polymerizable monomers while avoiding the disadvantages such as aggregation.

In the polymerization process, a polymerized toner is recovered from a suspension (slurry) containing the polymer particles formed through post-treatments such as dewatering, washing and drying. As processes for reducing the content of the residual polymerizable monomers in the resulting polymerized toner, have heretofore been known, for example, (1) a process of treating a polymerized toner after a drying step, (2) a process of treating a polymerized toner after a dewatering step and before a drying step, and (3) a process of treating a polymerized toner in a slurry before a dewatering step.

As the process (1), Japanese Patent Application Laid-Open No. 92736/1995 has proposed a process in which a dried polymerized toner is heated and subjected to a deaerating treatment under reduced pressure. This publication shows in the experimental results thereof that the amount of the polymerizable monomer remaining in the polymerized toner is reduced to 150 ppm. However, the heat treatment of the dried polymerized toner involves a problem that toner particles show a tendency to aggregate to one another. In the case of a toner (hereinafter referred to as "low-temperature fixing toner") the fixing temperature of which has been designed low so as to be suitable for use in high-speed printing or the like, the tendency becomes a great problem. The reason for it is that in the low-temperature fixing toner, those having a low glass transition temperature, melting point or the like are used as toner components including a binder resin component for the purpose of realizing fixing at a comparatively low temperature thereof, and so these components are softened to become liable to aggregate when the polymerized toner is heated. Accordingly, this process is an unpractical process for low-temperature fixing toners designed so as to lower the fixing temperature.

As the process (2), Japanese Patent Application Laid-Open No. 207122/1998 has proposed a process in which polymer particles containing a colorant are dried under reduced pressure while pouring a gas into the polymer particles. However, this process is difficult to remove the polymerizable monomer adsorbed on the colorant and the like though the amount of the residual polymerizable monomers can be reduced to about 100 ppm. Further, in this process, the polymer particles in a wet state are dried under reduced pressure while heating them. Therefore, when the process is applied to a low-temperature fixing toner, the treatment conditions must be carefully preset so as not to cause aggregation.

As the process (3), Japanese Patent Application Laid-Open No. 100485/1993 has proposed a process in which in a production process of a toner by the polymerization process, a liquid medium is removed while blowing the saturated vapor of the medium of the suspension, the saturated vapor of a water-soluble medium or a water-soluble gas into the suspension in the latter half of the reaction or after completion of the reaction. According to this process, the amount of the residual polymerizable monomers can be reduced to, for example, about 70 ppm. However, this process makes the toner particles easy to aggregate to one another by shearing force upon the contact of the saturated vapor or the like blown into the suspension with the toner particles and shows a tendency to produce scale and aggregate mass. Therefore, this process is difficult to stably provide a toner high in flowability. In particular, the polymerized toner particles have a stronger tendency to aggregate to deteriorate flowability as the particle diameter of the polymerized toner particles becomes smaller. The aggregation of the toner becomes an important problem for flowability as the particle diameter of the toner is made smaller.

As described above, the processes for reducing the amount of the residual polymerizable monomers by treatments after polymerization in the production process of a polymerized toner are variously investigated. However, the conventional processes have been difficult to meet the severe requirement for environmental safety in recent years that the content of the residual polymerizable monomers is lower than 100 ppm. In particular, it is more difficult to meet the requirement for low-temperature fixing toners.

DISCLOSURE OF THE INVENTION

It is an object of the present invention to provide a toner for development of electrostatic images, which is extremely low in the content of residual polymerizable monomers, excellent in environmental safety and moreover flowability and substantially spherical.

Another object of the present invention is to provide a production process of a toner for development of electrostatic images, by which the amount of residual polymerizable monomers can be reduced to a high degree without aggregating polymer particles formed.

The present inventors have carried out an extensive investigation with a view toward achieving the above objects. As a result, it has been found that when a slurry containing polymer particles is prepared by a polymerization process, and the slurry is subjected to a stripping treatment under reduced pressure, the amount of residual polymerizable monomers can be reduced to a high degree while avoiding the aggregation of the polymer particles. The present invention has been led to completion on the basis of this finding.

According to the present invention, there is thus provided a toner for development of electrostatic images, comprising at least a binder resin and a colorant, wherein (A) the content of residual polymerizable monomers in the toner is lower than 70 ppm, and (B) the toner is substantially spherical as demonstrated by the flowability of at least 55%.

According to the present invention, there is also provided a process for producing a toner for development of electrostatic images, comprising the step of subjecting a polymerizable monomer composition containing at least a colorant and a polymerizable monomer to suspension polymerization in an aqueous dispersion medium containing a dispersion stabilizer, the process comprising the steps of:

(1) forming polymer particles by suspension polymerization, thereby obtaining a slurry containing the polymer particles, (2) subjecting the slurry to a stripping treatment under conditions of reduced pressure to distill off volatile components including the aqueous dispersion medium and the polymerizable monomer, and (3) recovering the polymer particles from the remaining slurry.

BEST MODE FOR CARRYING OUT THE INVENTION

1. Toner for Development of Electrostatic Images

The toner for development of electrostatic images according to the present invention has a residual polymerizable monomer content lower than 70 ppm, preferably lower than 60 ppm, more preferably lower than 50 ppm.

The toner for development of electrostatic images according to the present invention has flowability of at least 55%, preferably at least 60%.

The toner for development of electrostatic images according to the present invention is a substantially spherical toner. More specifically, its spheroidicity represented by a value (Sc/Sr) obtained by dividing an area (Sc) of a circle supposing that the absolute maximum length of particles is a diameter by a substantial projected area (Sr) of the particles falls within a range of preferably 1.0 to 1.3.

The toner for development of electrostatic images according to the present invention has a volume average particle diameter (dv) of generally 2 to 15 $\mu$m, preferably 3 to 12 $\mu$m, more preferably 5 to 10 $\mu$m. When the toner for development of electrostatic images according to the present invention is used in the use application for providing high-definition image in particular, the volume average particle diameter (dv) thereof can be controlled to preferably 2 to 10 $\mu$m, more preferably 3 to 9 $\mu$m, particularly preferably 5 to 8 $\mu$m.

The particle diameter distribution represented by a ratio (dv/dn) of the volume average particle diameter (dv) to the number average particle diameter (dn) of the toner for development of electrostatic images according to the present invention is generally at most 1.7, preferably at most 1.5, more preferably at most 1.4. The lower limit of the particle diameter distribution is generally about 1.2.

The toner for development of electrostatic images according to the present invention is desirably such that a product (A×dn×D) of the BET specific surface area (A) [$m^2/g$], the number average particle diameter (dn) ($\mu$m) and the true specific gravity (D) falls within a range of 5 to 10.

The toner for development of electrostatic images according to the present invention preferably has a melt viscosity of at most $1.0\times10^5$ poises ($1.0\times10^4$ Pa.s) as measured at 120° C. from the viewpoints of coping with the speeding-up of printing, and the like. The melt viscosity is more preferably $1.0\times10^4$ to $1.0\times10^5$ poises, particularly preferably $1.0\times10^4$ to $8.0\times10^4$ poises. The melt viscosity is a value measured by means of a flow tester. The melt viscosity of the toner is lowered, thereby permitting coping with the speeding-up of printing, formation of full-color images, and the like. More specifically, the use of the toner having such a melt viscosity can realize high image quality even in high-speed printing. In addition, color toners of individual colors can be easily melted and color-mixed with each other upon fixing of the resulting color image.

The toner for development of electrostatic images according to the present invention is desirably reduced in the amount of residual metals (ions). When metals (ions) such as magnesium and calcium in particular remain in the toner in a comparatively great amount, such a toner undergoes moisture absorption under conditions of high humidity, so that the flowability of the toner may be deteriorated, or the image quality of the resulting image may be adversely affected. These residual metals (ions) are attributable to a dispersion stability and the like used in the suspension polymerization.

The toner for development of electrostatic images according to the present invention preferably has a residual metal content of at most 170 ppm. The content of the residual metals in the toner is more preferably at most 150 ppm, particularly preferably at most 120 ppm. The content of the residual metals in the toner is reduced, whereby good image quality high in print density and free of fogging can be achieved even by using a high-speed machine capable of conducting printing in a proportion of 10 sheets of paper per minute. In order to reduce the content of the residual metals in the toner, it is only necessary to conduct dewatering and washing using a washing and dewatering machine such as a continuous belt filter or siphon pillar type centrifuge at, for example, a dewatering step in the production process of the toner.

The content of the residual polymerizable monomers, flowability, volume average particle diameter, content of the residual metals, etc. are values measured in accordance with the respective measuring methods described in Examples, which will be described subsequently.

The toner for development of electrostatic images according to the present invention can be preferably produced by the polymerization process. The toner for development of electrostatic images obtained by the polymerization process is composed of colored polymer particles containing a colorant obtained by subjecting a polymerizable monomer composition containing at least the colorant and a polymerizable monomer to suspension polymerization. The toner for development of electrostatic images according to the present invention may be also composed of polymer particles of a core.shell structure that a polymerizable monomer is polymerized in the presence of the colored polymer particles, thereby forming a polymer layer for covering the colored polymer particles.

The toner of the core.shell structure is preferably a capsule toner having a layer structure composed of a core substance and a shell substance which covers the core substance and has a glass transition temperature higher than the core substance from the viewpoint of reconciling low-temperature fixing ability with shelf stability (blocking resistance). In the case of the polymerized toner, it is preferred that a polymerizable monomer composition containing at least a colorant and a polymerizable monomer be subjected to suspension polymerization to form colored polymer particles containing the colorant, and a monomer capable of forming a polymer having a glass transition temperature higher than that of the polymer component making up the colored polymer particles (core particles) be polymerized in the presence of the colored polymer particles, thereby forming core.shell type polymer particles that a polymer layer (shell) covering each of the colored polymer particles has been formed.

When the toner for development of electrostatic images according to the present invention is provided as core.shell type polymer particles, the glass transition temperature of the polymer component making up the core particles can be set lower to the extent of preferably at most 60° C., more preferably 40 to 60° C. to design the toner so as to lower the fixing temperature thereof. On the other hand, when the glass transition temperature of the polymer component making up the this shell layer is made higher by preferably at least 10° C., more preferably at least 20° C. than that of the polymer component making up the core particles, the toner can be prevented from undergoing blocking during its storage or in a toner box to impair the flowability thereof.

The toner for development of electrostatic images according to the present invention may be subjected to a treatment by classifying and/or with external additives as needed.

2. Production Process of Polymerized Toner

As a process for producing a toner for development of electrostatic images, which has a residual polymerizable monomer content lower than 70 ppm and excellent flowability, is preferred a method in which the polymerization process is adopted to subject a slurry (suspension) containing polymer particles formed after polymerization to a stripping treatment under reduced pressure.

In the polymerization process, a polymerizable monomer composition containing a polymerizable monomer and a colorant, and optionally a crosslinkable monomer, a crosslinkable polymer, a macromonomer, a molecular weight modifier, a lubricant, a dispersion aid, charge control agent, a parting agent, a polymerization initiator and other various additives is generally subjected to suspension polymerization in an aqueous dispersion medium containing a dispersion stabilizer to form colored polymer particles.

When a capsule toner is produced, a polymerizable monomer is polymerized in the presence of the above-described colored polymer particles to form a polymer layer (shell) covering the colored polymer particles (core), thereby producing core.shell type polymer particles.

In the production process according to the present invention, a slurry containing polymer particles is first prepared by suspension polymerization, and the slurry is subjected to a stripping treatment under reduced pressure. The slurry containing the polymer particles is subjected to the stripping treatment under reduced pressure, thereby distilling off a great amount of the aqueous dispersion medium together with an unreacted polymerizable monomer. Therefore, the residual polymerizable monomers is efficiently removed from the polymer particles. In the slurry, the polymer particles are protected by the dispersion stabilizer (preferably colloid of a metallic compound), so that the aggregation of the polymer particles can be prevented even when the treatment temperature is raised to a temperature higher than the glass transition temperature of the polymer component.

(1) Polymerizable Monomer

As the polymerizable monomer, is preferred a monovinyl monomer.

Specific examples thereof include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

These monovinyl monomers may be used either singly or in any combination thereof. Among the monovinyl monomers, the styrenic monomers and the derivatives of (meth)acrylic acid are preferably used in combination.

(2) Colorant

As the colorant, may be used any of various kinds of pigments and dyes used in the field of toners, such as carbon black and titanium white. As examples of black colorants, may be mentioned dyes and pigments such as carbon black and Nigrosine Base; and magnetic powders such as cobalt, nickel, triiron tetroxide, manganese iron oxide, zinc iron oxide and nickel iron oxide. When carbon black is used, that having a primary particle diameter of 20 to 40 nm is preferably used in that the resulting toner can provide images good in image quality, and the safety of the toner in environment is enhanced.

As colorants for color toners, may be used yellow colorants, magenta colorants, cyan colorants, etc.

Examples of the yellow colorants include C.I. Pigment Yellow 3, 12, 13, 14, 15, 17, 62, 65, 73, 83, 90, 93, 97, 120, 138, 155, 180 and 181; Naphthol Yellow S, Hansa Yellow G, and C.I. Vat Yellow.

Examples of the magenta colorants include azo pigments, fused polycyclic pigments, etc., and specific examples thereof include C.I. Pigment Red 48, 57, 58, 60, 63, 64, 68, 81, 83, 87, 88, 89, 90, 112, 114, 122, 123, 144, 146, 163, 170, 184, 185, 187, 202, 206, 207, 209 and 251; and C.I. Pigment Violet 19.

Examples of the cyan colorants include copper phthalocyanine compounds and derivatives thereof, and anthraquinone compounds, and specific examples thereof C.I. Pigment Blue 2, 3, 6, 15, 15:1, 15:2, 15:3, 15:4, 16, 17 and 60; Phthalocyanine Blue, C.I. Vat Blue 6, and C.I. Acid Blue.

The colorants are used in a proportion of generally 0.1 to 50 parts by weight, preferably 1 to 20 parts by weight per 100 parts by weight of the binder resin or the polymerizable monomer forming the binder resin.

(3) Crosslinkable Monomer and Crosslinkable Polymer

When a crosslinkable monomer and/or a crosslinkable polymer is used together with the polymerizable monomer, the hot offset resistance of the resulting toner is effectively improved.

The crosslinkable monomer is a monomer having two or more polymerizable carbon-carbon unsaturated double bonds. As specific examples thereof, may be mentioned aromatic divinyl compounds such as divinylbenzene, divinylnaphthalene and derivatives thereof; ethylenically unsaturated carboxylic acid diesters such as ethylene glycol dimethacrylate and diethylene glycol dimethacrylate; (meth) acrylates derived from aliphatic both-terminal alcohols such as 1,4-butanediol and 1,9-nonanediol; and other divinyl compounds such as N,N-divinylaniline and divinyl ether; and compounds having three or more vinyl groups.

As examples of the crosslinkable polymers, may be mentioned polyethylene and polypropylene having at least two hydroxyl groups in their molecules, polyester and methacrylates derived from polysiloxane. These crosslinkable monomers and crosslinkable polymers may be used either singly or in any combination thereof.

The crosslinkable monomers and crosslinkable polymers are used in a proportion of generally at most 10 parts by weight, preferably 0.05 to 5 parts by weight, more preferably 0.1 to 2 parts by weight per 100 parts by weight of the polymerizable monomer.

(4) Macromonomer

When a macromonomer is used together with the polymerizable monomer, a balance between the shelf stability and offset resistance, and the low-temperature fixing ability of the resulting toner can be improved. The macromonomer is a relatively long-chain linear molecule having a polymerizable functional group (for example, a unsaturated group such as a carbon-carbon double bond) at its molecular chain terminal. As the macromonomer, is preferred an oligomer or polymer having a number average molecular weight of generally 1,000 to 30,000. If a macromonomer having a too low number average molecular weight is used, the surface part of the resulting toner becomes soft, and its shelf stability may be deteriorated in some cases. If a macromonomer having a too high number average molecular weight is used on the other hand, the flowability of the macromonomer becomes poor, and the fixing ability of the resulting toner may be deteriorated in some cases.

Specific examples of the macromonomer include polymers obtained by polymerizing styrene, styrene derivatives, methacrylic esters, acrylic esters, acrylonitrile and methacrylonitrile either singly or in combination of two or more monomers thereof; and macromonomers having a polysiloxane skeleton. Of these macromonomers, polymers having a glass transition temperature higher than that of the binder resin are preferred, with copolymer macromonomers of styrene and a methacrylic ester and/or an acrylic ester, or polymethacrylic ester copolymer macromonomers being particularly preferred.

When the macromonomer is used, the amount of the macromonomer used is generally 0.01 to 10 parts by weight, preferably 0.03 to 5 parts by weight, more preferably 0.05 to 1 part by weight per 100 parts by weight of the polymerizable monomer. If the amount of the macromonomer used is too great, the resulting toner shows a tendency to be deteriorated in fixing ability.

(5) Molecular Weight Modifier

As examples of the molecular weight modifier, may be mentioned mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization.

The molecular weight modifier is used in a proportion of generally 0.01 to 10 parts by weight, preferably 0.1 to 5 parts by weight per 100 parts by weight of the polymerizable monomer.

(6) Lubricant and Dispersion Aid

A lubricant, such as a fatty acid such as oleic acid or stearic acid, or a fatty acid metal salt composed of a fatty acid and a metal such as Na, K, Ca, Mg or Zn; a dispersion aid such as a silane or titanium coupling agent; and/or the like may also be used with a view toward uniformly dispersing the colorant in the resulting toner particles.

Such a lubricant or dispersion aid is generally used in a proportion of about 1/1,000 to 1/1 based on the weight of the colorant.

(7) Charge Control Agent

In order to improve the charge properties of the resulting toner, various kinds of charge control agents having positively charging ability or negatively charging ability are preferably contained in the polymerizable monomer composition.

As the charge control agents, may be used, for example, charge control agents such as Bontron N01 (product of Orient Chemical Industries Ltd.), Nigrosine Base EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-81 (product of Orient Chemical Industries Ltd.), Bontron E-84 (product of Orient Chemical Industries Ltd.), Bontron E-89 (product of Orient Chemical Industries Ltd.), Bontron F-21 (product of Orient Chemical Industries Ltd.), Copy CHRGE NX (product of Clariant Co.), Copy CHRGE NEG (product of Clariant Co.), TNS-4-1 (product of Hodogaya Chemical Co., Ltd.), TNS-4-2 (product of Hodogaya Chemical Co., Ltd.) and LR-147 (product of The Japan Carlit Co., Ltd.); charge control resins such as quaternary ammonium (salt) group-containing copolymers described in Japanese Patent Application Laid-Open Nos. 15192/1999, 175456/1991 and 243954/1991, etc., and sulfonic (salt) group-containing copolymers described in Japanese Patent Application Laid-Open Nos. 243954/1991, 217464/1989 and 15858/1991, etc., and the like The charge control agent is used in a proportion of generally 0.01 to 10 parts by weight, preferably 0.03 to 8 parts by weight per 100 parts by weight of the binder resin or the polymerizable monomer forming the binder resin.

(8) Parting Agent

In the present invention, various kinds of parting agents may be contained, as needed, for the purpose of preventing offset and the like.

Examples of the parting agents include low molecular weight polyolefin waxes such as low molecular weight polyethylene, low molecular weight polypropylene and low molecular weight polybutylene; terminal-modified polyolefin waxes such as molecule terminal-oxidized low molecular weight polypropylene, molecular terminal-modified low molecular weight polypropylene substituted by an epoxy group at its molecular terminal and block polymers of these compounds with low molecular weight polyethylene, and molecule terminal-oxidized low molecular weight polyethylene, molecular terminal-modified low molecular weight polyethylene substituted by an epoxy group at its molecular terminal and block polymers of these compounds with low molecular weight polypropylene; vegetable natural waxes such as candelilla wax, carnauba wax, rice wax, Japan wax and jojoba wax; petroleum waxes such as paraffin wax, microcrystalline wax and petroleum, and modified waxes thereof; mineral waxes such as montan, ceresin and ozokerite; synthetic waxes such as Fischer-Tropsch wax; polyfunctional ester compounds such as pentaerythritol tetramyristate and pentaerythritol tetrastearate; and mixtures of two or more these compounds.

Among these parting agents, the synthetic waxes (particularly, Fischer-Tropsch wax), synthetic polyolefins, low molecular weight polypropylene wax and microcrystalline wax are preferred. Of these, the use of a parting agent whose endothermic peak temperature falls within a range of 30 to 200° C., preferably 50 to 180° C., more preferably 60 to 160° C. is particularly preferred, since the resulting toner can be well balanced between the fixing ability and the parting property. The endothermic peak temperature is a value measured in accordance with ASTM D 3418-82.

The parting agent is used in a proportion of generally 0.1 to 20 parts by weight, preferably 1 to 10 parts by weight per 100 parts by weight of the polymerizable monomer.

(9) Polymerization Initiator

As the polymerization initiator, is preferably used a radical polymerization initiator. Specific examples thereof include persulfates such as potassium persulfate and ammonium persulfate; azo compounds such as 4,4'-azobis(4-cyanovaleric acid), 2,2'-azobis(2-amidino-propane) bihydrochloride, 2,2'-azobis-2-methyl-N-1,1-bis (hydroxymethyl)-2-hydroxyethylpropionamide, 2,2'-azobis (2,4-dimethylvaleronitrile), 2,2'-azobis-isobutyronitrile and 1,1'-azobis(1-cyclohexane-carbonitrile); diacyl peroxides such as isobutyryl peroxide, 2,4-di-chlorobenzoyl peroxide and 3,5,5'-trimethylhexanoyl peroxide; peroxy dicarbonates such as bis(4-t-butylcyclohexyl)peroxy dicarbonate, di-n-propylperoxy dicarbonate, diisopropylperoxy dicarbonate, di-2-ethoxyethylperoxy dicarbonate, di(2-ethylethylperoxy) dicarbonate, dimethoxybutylperoxy dicarbonate and di(3-methyl-3-methoxybutylperoxy) dicarbonate; and other peroxides such as (α,α-bis-neodecanoylperoxy)-diisopropylbenzene, cumylperoxy neodecanoate, 1,1',3,3'-tetramethylbutylperoxy neodecanoate, 1-cyclohexyl-1-methylethylperoxy neodecanoate, t-hexylperoxy neodecanoate, t-butylperoxy neodecanoate, t-hexylperoxy pivalate, t-butylperoxy pivalate, methyl ethyl peroxide, di-t-butyl peroxide, acetyl peroxide, dicumyl peroxide, lauroyl peroxide, benzoyl peroxide, t-butylperoxy-2-ethyl hexanoate, di-isopropylperoxy dicarbonate, di-t-butylperoxy isophthalate and t-butylperoxy isobutyrate. Redox initiators composed of combinations of these polymerization initiators with a reducing agent may also be used.

Among these, oil-soluble radical initiators soluble in the polymerizable monomer are preferred. A water-soluble initiator may also be used in combination therewith as needed. The proportion of the polymerization initiator used is generally 0.1 to 20 parts by weight, preferably 0.3 to 15 parts by weight, more preferably 0.5 to 10 parts by weight per 100 parts by weight of the polymerizable monomer. If this proportion is too low, the rate of polymerization becomes slow. If the proportion is too high, the molecular weight of the resulting polymer becomes low.

Although the polymerization initiator may be added into the polymerizable monomer composition, it may also be added into the suspension after completion of the step of forming droplets of the polymerizable monomer composition in the aqueous dispersion medium to cause it to migrate into the droplets of the polymerizable monomer composition in order to avoid premature polymerization, the time when a polymerization initiator is added may be the time the size of the droplets in the aqueous dispersion medium has become uniform.

(10) Dispersion Stabilizer

As examples of the dispersion stabilizer used in the present invention, may be mentioned sulfates such as barium sulfate and calcium sulfate; carbonates such as barium carbonate, calcium carbonate and magnesium carbonate;

phosphates such as calcium phosphate; metal oxides such as aluminum oxide and titanium oxide; metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants.

Among these, metallic compounds such as the sulfates, carbonates, metal oxides and metal hydroxides are preferred, with colloid of hardly water-soluble metallic compounds being more preferred. In particular, colloid of hardly water-soluble metal hydroxides is preferred because the particle diameter distribution of the resulting toner particles can be narrowed, and the brightness or sharpness of an image formed from such a toner is enhanced.

The colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase.

The colloid of the hardly water-soluble metal hydroxide preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization reaction system is broken, and the shelf stability of the resulting toner is also deteriorated.

The dispersion stabilizer is used in a proportion of generally 0.1 to 20 parts by weight, preferably 0.3 to 10 parts by weight per 100 parts by weight of the polymerizable monomer. If the proportion of the dispersion stabilizer used is too low, it is difficult to achieve sufficient polymerization stability, so that polymer aggregates are liable to form. If the proportion of the dispersion stabilizer used is too high on the other hand, the particle diameter distribution of the resulting toner becomes broad due to the increase of fine particles, or the viscosity of the aqueous solution is increased to lower polymerization stability.

(11) Production Process of Colored Polymer Particles

A polymerized toner can be provided as colored polymer particles containing the colorant and the like by subjecting a polymerizable monomer composition containing at least a polymerizable monomer and a colorant to suspension polymerization in an aqueous medium containing a dispersion stabilizer.

More specifically, the polymerizable monomer, colorant, charge control agent, parting agent, etc. are mixed, and the resultant mixture is uniformly dispersed by means of a bead mill or the like to prepare a polymerizable monomer composition which is an oily liquid mixture. The polymerizable monomer composition is then poured into the aqueous medium containing the dispersion stabilizer, and the resultant suspension is stirred by a stirrer. After the droplet diameter of droplets of the polymerizable monomer composition becomes uniform, the polymerization initiator is poured to cause it to migrate into the droplets of the polymerizable monomer composition.

The droplets of the polymerizable monomer composition are then made finer by means of a mixing device having high shearing force. After droplets having a droplet diameter almost equal to the particle diameter of a polymerized toner to be formed are formed in the above-described manner, polymerization is conducted at a temperature of generally 30 to 200° C. Colored polymer particles are formed in such a manner. The colored polymer particles formed are recovered and then used as a polymerized toner.

(12) Production Process of Core.shell Type Polymer Particles

A capsule toner having a core.shell structure may be generally produced in accordance with a spray drying process, interface reaction process, in situ polymerization process, phase separation process or the like.

In the in situ polymerization process preferably adopted in the present invention, the colored polymer particles obtained by subjecting the polymerizable monomer composition containing at least the polymerizable monomer and the colorant to suspension polymerization are used as core, and a polymerizable monomer for shell is subjected to suspension polymerization in the presence of the core, thereby forming core.shell type polymer particles.

When a water-soluble polymerization initiator is used upon the addition of the polymerizable monomer for shell to the polymerization reaction system, the polymer particles having the core.shell structure are easy to be formed.

As examples of the water-soluble polymerization initiators, may be mentioned persulfates such as potassium persulfate and ammonium persulfate; azo type initiators such as 4,4'-azobis(4-cyanovaleric acid), 2,2'-azobis(2-amidinopropane)bihydrochloride and 2,2'-azobis-2-methyl-N-1,1'-bis(hydroxymethyl)-2-hydroxyethylpropionamide; and combinations of an oil-soluble initiator such as cumene peroxide and a redox catalyst. The amount of the water-soluble polymerization initiator is generally 0.001 to 3% by weight based on the aqueous dispersion medium.

When a polymerizable monomer capable of forming a polymer having a glass transition temperature higher than that of the polymer component forming the colored polymer particles of the core is used as the polymerizable monomer for shell, the blocking resistance, i.e., shelf stability, of the resulting polymerized toner can be enhanced.

As the polymerizable monomer for core, is preferred a monomer capable of forming a polymer having a glass transition temperature of generally at most 60° C., preferably about 40 to 60° C. As the polymerizable monomer for shell, is preferred a monomer capable of forming a polymer having a glass transition temperature higher by at least 10° C., preferably at least 20° C., more preferably at least 30° C. than that of the polymer component forming the core.

The glass transition temperature of the polymer formed from the polymerizable monomer for shell is generally higher than 50° C., but not higher than 120° C., preferably higher than 60° C., but not higher than 110° C., more preferably 80° C. to 105° C. The glass transition temperature can be measured by observation, but may also be calculated out from the kind(s) and proportion(s) of monomer(s) used in accordance with a method known per se in the art.

A proportion of the polymerizable monomer for core to the polymerizable monomer for shell to be used is generally 80:20 to 99.9:0.1 in terms of a weight ratio. If the proportion of the polymerizable monomer for shell is too low, the effect of improving the shelf stability becomes little. If the proportion is too high on the other hand, the improving effect to lower the fixing temperature of the resulting polymerized toner becomes little.

The thickness of the shell is generally 0.001 to 1.0 $\mu$m, preferably 0.003 to 0.5 $\mu$m, more preferably 0.005 to 0.2 $\mu$m.

3. Stripping Treatment under Reduced Pressure

In the present invention, a slurry (may be referred to as suspension or dispersion) containing polymer particles is prepared by suspension polymerization, and the slurry is subjected to a stripping treatment under reduced pressure to a volatile component containing an aqueous dispersion medium and a polymerizable monomer.

By the stripping treatment under reduced pressure, a great amount of the aqueous dispersion medium is distilled off together with an unreacted polymerizable monomer, whereby the amount of the volatile substances such as the residual polymerizable monomers remaining in the polymer particles can be reduced.

The stripping treatment under reduced pressure is generally conducted within a vacuumized evaporation tank. Since the volatile substances are gasified in the stripping treatment under reduced pressure, they are generally discharged outward from the evaporation tank. The discharged volatile substances may be recovered as needed.

The slurry to be subjected to the stripping treatment under reduced pressure may be that from which the dispersion stabilizer used upon the polymerization has been removed by acid washing or the like. However, it is desirable that the dispersion stabilizer be caused to exist for the purpose of maintaining the dispersion stability of the slurry during the stripping treatment under reduced pressure. The dispersion stability may be added into the slurry for the purpose of stably performing the stripping treatment under reduced pressure.

In the step of the stripping treatment under reduced pressure, it is desirable that the stripping treatment under reduced pressure be conducted while controlling the temperature of the slurry in such a manner that the temperature Ts (°C.) of the slurry and the lowest glass transition temperature Tg (°C.) of the polymer component in the polymer particles satisfy the following relationship (I):

$$Tg \leqq Ts < 100\ (^\circ\mathrm{C.}) \qquad \text{(I)}$$

It is more desirable that the stripping treatment under reduced pressure be conducted while controlling the temperature of the slurry in such a manner that the temperature Ts (°C.) of the slurry and the lowest glass transition temperature Tg (°C.) of the polymer component in the polymer particles satisfy the following relationship (II):

$$Tg \leqq Ts < 90^\circ\ \mathrm{C.} \qquad \text{(II)}$$

It is particularly desirable that the stripping treatment under reduced pressure be conducted while controlling the temperature of the slurry in such a manner that the temperature Ts (°C.) of the slurry and the lowest glass transition temperature Tg (°C.) of the polymer component in the polymer particles satisfy the following relationship (III):

$$Tg + 5^\circ\ \mathrm{C.} \leqq Ts \leqq 85^\circ\ \mathrm{C.} \qquad \text{(III)}$$

It is also desirable that the temperature of the slurry be kept constant within the above-described range during the stripping treatment under reduced pressure. If Ts is lower than Tg, the amount of the volatile component evaporated is lessened, and moreover the migration of the residual polymerizable monomers in the polymer particles is extremely slowed, so that the removal efficiency of the residual polymerizable monomers is lowered. From this point of view, it is desirable that Ts be preset higher at least 5° C. than Tg. On the other hand, if Ts is higher than 100° C., the dispersion stability of the polymer particles is deteriorated by the heat, so that aggregates occurs during the treatment, or adhesion of scale to the wall of the evaporation tank and a stirrer occurs.

In this case, when the polymer component (binder resin) has at least 2 glass transition temperatures Tg, the temperature of the slurry is controlled on the basis of the lowest Tg. The Tg is a value measured by a differential scanning calorimeter (DSC).

The temperature of the slurry may be controlled to a predetermined temperature either by means of a heat exchanger installed in the evaporation tank or by gradually heating the slurry by a heat exchanger (hereinafter referred to as "external heat exchanger") provided outside the evaporation tank while circulating it between the external heat exchanger and the evaporation tank. A method in which a process that the slurry is returned to the evaporation tank while flashing the slurry heated by means of the external heat exchanger is conducted repeatedly is particularly preferred.

In the stripping treatment under reduced pressure, it is preferred that the treatment be conducted by controlling the pressure to 50 to 500 Torr. The pressure within the evaporation tank is determined according to the relationship between the treatment temperature and the vapor pressure of the aqueous dispersion medium. In the present invention, however, the pressure is preferably controlled within a range of 50 to 500 Torr. If this pressure is too high, the slurry comes to be heated to a considerably high temperature, so that the dispersion stability of the slurry is easy to be deteriorate. When the slurry is heated to a too high temperature by the heat exchanger, the dispersion stability of the slurry at the heat exchanger portion is deteriorated, and so aggregate occurs during the treatment, or scale adheres to the wall of the heat exchanger. If this pressure is too low on the other hand, the pressure of the evaporation tank becomes too low against the vapor pressure of the aqueous dispersion medium at the treatment temperature, so that the vapor-liquid equilibrium shifts to the vapor side at a stretch. As a result, boiling of the aqueous dispersion medium and other volatile components from the interior of the slurry in the evaporation tank begins to markedly cause bubbling. Therefore, it is difficult to stably conduct the treatment.

The treatment time of stripping under reduced pressure is generally 0.5 to 50 hours, preferably 1 to 30 hours, more preferably 3 to 20 hours.

In the stripping treatment under reduced pressure, it is preferred to repeatedly conduct a process of injecting (i.e., flashing) a part of the slurry toward the lower part of the evaporation tank from the upper part thereof, from the viewpoint of efficiently conducting evaporation of the volatile substances. When the flashing is conducted, a process of first taking the slurry directly in an external device and returning the slurry to the evaporation tank by flashing from the external device may be repeated. However, it is preferable to repeat a process of first placing the slurry in the evaporation tank, taking a part of the slurry in the external device and then returning the slurry to the evaporation tank by flashing from the external device. The reason for it is that when the slurry is present at the lower part of the evaporation tank, bubbling at the liquid level by the flashing can be prevented.

In the stripping treatment under reduced pressure, concentration of the slurry within the evaporation tank is simultaneously conducted due to the evaporation and recovery of the aqueous dispersion medium and other volatile substances. When the stability of the slurry is lowered by the increase in the concentration of the slurry, the stripping under reduced pressure may be conducted while adding an aqueous dispersion medium into the evaporation tank within limits not unstabilizing the balance between the temperature and pressure of the slurry in the evaporation tank. From the viewpoint of continuously conducting a stable treatment, it is desirable that an aqueous dispersion medium be newly added into the evaporation tank in an amount almost corresponding to the amount of the aqueous dispersion medium distilled off during the stripping treatment under reduced pressure. The aqueous dispersion medium added later may be the same or different from the aqueous dispersion medium used upon the suspension polymerization. However, the same medium is generally used. The aqueous dispersion medium added may or may not contain the dispersion stabilizer.

When the slurry is heated upon the stripping treatment under reduced pressure, the evaporation and recovery efficiency of the.volatile substances such as water and the polymerizable monomer becomes high. Examples of a method for heating the slurry include a method making use of an evaporation tank equipped with a heat medium-circulating jacket, a method making use of an evaporation tank with a heat exchanger provided therein, a method making use of an evaporation tank connected to an external heat exchanger, and a method blowing a heating gas into an evaporation tank. Among these heating methods, the method making use of the evaporation tank connected to the external heat exchanger is preferred.

When the evaporation tank connected to the external heat exchanger is used, the slurry within the evaporation tank is sent to the external heat exchanger, and the slurry heated by the external heat exchanger is flashed into the vacuumized evaporation tank. In this case, the slurry is circulated between the evaporation tank and the external heat exchanger to conduct the stripping treatment under reduced pressure, and the slurry heated by the external heat exchanger is preferably returned to the bottom of the evaporation tank while flashing the heated slurry from the top of the evaporation tank.

When the external heat exchanger is used, the temperature of the slurry to be heated by the external heat exchanger is preferably set to a temperature higher than the temperature of the slurry within the evaporation tank. A difference in temperature in this case is of the order of generally 5 to 50° C., preferably 10 to 20° C. If the temperature difference is too small, the evaporation of the volatile substances becomes insufficient upon flashing within the evaporation tank, so that the removal efficiency of the residual polymerizable monomers is lowered. No particular limitation is imposed of the form of the external heat exchanger. However, a plate type heat exchanger which is wide in contact area upon heating and capable of efficiently heating the slurry even when the temperature of a heat medium used is low is preferred for the purpose of preventing aggregation or the like due to unstabilization of the slurry upon heating or circulation.

In the present invention, in order to facilitate the renewal of the interface between the polymer particles and the aqueous dispersion medium in the slurry to promote evaporation of the residual polymerizable monomers, the stripping treatment under reduced pressure may be conducted while blowing a gas into the liquid phase within the evaporation tank within limits not unstabilizing balance between the temperature and the pressure in the evaporation tank. No particular limitation is imposed on the gas blown. Examples thereof include water vapor, dry air, nitrogen, argon, helium and carbon dioxide. Among these, water-insoluble and incombustible gases are preferred. When the gas is blown, it is preferred that the temperature of the gas be controlled to a temperature lower than 100° C. from the viewpoint of preventing the aggregation of the polymer particles. However, the blowing of the gas may not be conducted for the purpose of avoiding aggregation of the polymer particles by shearing force.

In the present invention, after the stripping treatment under reduced pressure, the polymer particles are subjected to dewatering, washing and drying treatments generally conducted, thereby recovering dry polymer particles (polymerized toner). In the recovering step, polymer particles having a residual polymerizable monomer content lower than 70 ppm, preferably lower than 60 ppm, more preferably lower than 50 ppm can be recovered after dewatering, washing and drying. The recovered polymer particles have flowability of at least 55%, preferably at least 60% and are substantially spherical. In addition, the recovered polymer particles are polymer particles having a melt viscosity of at most $1.0\times10^5$ poises as measured at 120° C.

4. Developer

The polymerized toner obtained by the production process according to the present invention may be used as a developer for development of electrostatic images as it is. However, it may be used in combination with general-purpose external additives, as needed, for the purpose of improving the flowability, abrasion property and the like. The external additives include inorganic particles and/or organic resin particles.

Examples of the inorganic particles include particles of silica, alumina, titanium oxide, zinc oxide, tin oxide, barium titanate, strontium titanate, etc.

Examples of the organic resin particles include particles of methacrylic ester copolymers, acrylic ester polymers, styrene-methacrylic ester copolymers and styrene-acrylic ester copolymers, zinc stearate, calcium stearate, and core-shell type particles in which the core is composed of a methacrylic ester polymer, and the shell is composed of a styrene polymer.

Among these, the particles of the inorganic oxides, particularly silica particles are preferred. The surfaces of these particles may be subjected to a hydrophobicity-imparting treatment. Silicon dioxide particles subjected to the hydrophobicity-imparting treatment are particularly preferred. No particular limitation is imposed on the amount of the external additives added. However, it is generally 0.1 to 6 parts by weight per 100 parts by weight of the polymerized toner.

Two or more of the external additives may be used in combination. When the external additives are used in combination, it is preferable to use two or more kinds of inorganic particles or inorganic particles and organic resin particles, which are different in average particle diameter from each other, in combination. The adhesion of the external additives to the toner particles is generally conducted by charging them into a mixer such as a Henschel mixer to mix them under stirring.

The use of the polymerized toner according to the present invention, particularly, the polymerized toner composed of the core.shell type polymer particles permits designing a fixing temperature to a low temperature, preventing aggregation upon drying, shortening drying time, improving a yield in the subsequent classification step and increasing shelf stability.

EXAMPLES

The present invention will hereinafter be described more specifically by the following examples and comparative examples. However, the present invention is not limited to these examples only. Incidentally, all designations of "part" or "parts" and "%" as will be used in the following examples mean part or parts by weight and % by weight unless expressly noted.

Physical properties and properties or characteristics in the examples were determined in accordance with the following respective methods.

(1) Endothermic Peak Temperature

The endothermic peak temperature of a synthetic wax sample was measured in accordance with ASTM D 3418-82. Specifically, a differential scanning calorimeter (DSC; manufactured by Seiko Instruments Inc.; "SSC5200", trade name) was used to heat the sample at a heating rate of 10° C./min, thereby preparing a DSC curve. The peak top temperature thereof was regarded as the endothermic peak temperature of the sample.

(2) Particle Diameter and Particle Diameter Distribution

The volume average particle diameter (dv) and particle diameter distribution represented by a ratio (dv/dn) of the volume average particle diameter (dv) to the number average particle diameter (dn) of each polymer particle sample (toner particle sample) were measured by means of a Multisizer (manufactured by Coulter Co.). The measurement by the Multisizer was conducted under the following conditions:

Aperture diameter: 100 μm;

Medium: Isothone II, concentration: 10%; and

Number of particles measured: 50,000 particles.

(3) Spheroidicity

The spheroidicity of each polymer particle sample (toner particle sample) is represented by a value (Sc/Sr) obtained by dividing an area (Sc) of a circle supposing that the absolute maximum length of particles is a diameter by a substantial projected area (Sr) of the particles. The values of 100 particles were determined from reflecting electron microphotographs of the polymer particles, and an average value thereof was calculated out.

(4) Content of Residual Polymerizable Monomers

The content of residual polymerizable monomers in a polymer particle sample (toner particle sample) was measured by means of gas chromatography in accordance with the following conditions and method.

<Measuring Conditions>

Column: TC-WAX (0.25 mm×30 m)

Column temperature: 80° C.

Injection temperature: 200° C.

FID detection side temperature: 200° C.

<Measuring Method>

After a slurry sample containing polymer particles was subjected to a dewatering treatment, 0.7 g of wet polymer particles before drying or polymer particles (toner particles) after drying were precisely weighed to mg unit, and methanol was added to the precisely weighed polymer particle sample to disperse the particle sample by ultrasonic waves. After methanol was added to the resultant dispersion to a volume of 10 ml, the resultant mixture was left at rest for 24 hours at room temperature to extract residual polymerizable monomers from the polymer particles. After the dispersion was then centrifuged to precipitate insoluble matter, a supernatant (2 μl) was taken out and poured into a gas chromatograph to identify the content of the residual polymerizable monomers. A methanol solution of each polymerizable monomer was used as a standard sample for determination.

After dewatering, the content of the residual polymerizable monomers in the polymer particles before drying was calculated out as a ratio to pure solids in the wet sample. The pure solids in the wet sample were found by ① precisely weighing 1 g of the wet polymer particles to mg unit at the same time as taking out the wet polymer particles for operation of the sample preparation, ② heating and drying the precisely weighted polymer particle sample at about 200° C. for 30 minutes by an infrared lamp and then precisely weighing the weight of the dry polymer particle sample, ③ calculating a proportion of the pure solids from a difference in weight between before and after drying, and ④ multiplying this proportion by the weight of the wet polymer particle sample used for the determination of the content of the residual polymerizable monomers.

The content of the residual polymerizable monomers in the polymer particles after drying was calculated out as a ratio to the weight of said polymer particle.

(5) Flowability

Three kinds of sieves having sieve openings of 150 μm, 75 μm and 45 μm, respectively, were laid on top of another in that order from above, and a developer sample (4 g) to be measured was precisely weighed and put on the uppermost sieve. The three kinds of sieves were then vibrated for 15 seconds by means of a powder measuring device ("REOSTAT", trade name; manufactured by Hosokawa Micron Corporation) under conditions of vibration intensity of 4. Thereafter, the weight of the developer captured on each sieve was measured and substituted into its corresponding equation ①, ② or ③ shown below, thereby finding the value of a, b and c. These values were substituted into the equation ④ to calculate out the value of flowability. The measurement was conducted 3 times on one sample to find an average value thereof.

$a$=[(weight (g) of the developer remaining on the sieve of 150 μm)/4 g]×100 ①

$b$=[(weight (g) of the developer remaining on the sieve of 75 μm/)4 g]×100×0.6 ②

$c$=[(weight (g) of the developer remaining on the sieve of 45 μm)/4 g]×100×0.2 ③

Flowability (%)=100−($a$+$b$+$c$). ④

(6) Residual Metal Content

The residual metal content in a polymer particle sample (toner particle sample) was determined as the content of a magnesium ion derived from the metal compound used as the dispersion stabilizer upon suspension polymerization be means of an inductively coupled plasma emission spectrometer (ICP; manufactured by Seiko Instruments Inc.).

(7) Melt Viscosity

The melt viscosity of a polymer particle sample (toner particle sample) was measured as a melt viscosity at 120° C. under the following conditions by means of a flow tester ("CFT-500C", trade name; manufactured by Shimadzu Corporation).

<Measuring Conditions>

Initial temperature: 35° C.

Heating rate: 3° C./min

Preheating time: 5 minutes

Cylinder pressure: 1.0 kg.f/cm$^2$

Die diameter: 0.5 mm

Die length: 1.0 mm

Shear stress: 2.451×10$^5$ Pa

Amount of sample charged: 1.0 to 1.3 g.

(8) Evaluation of Image Quality

The image quality of an image formed with each developer sample was evaluated by conducting a continuous printing test under respective environments of high temperature and high humidity (H/H), and low temperature and low humidity (L/L).

A commercially available printer (printing speed: 12 sheets/min) of the non-magnetic one-component development system was modified in such a manner that the temperature of a fixing roll can be varied. This modified printer was used to continuously conduct printing from the beginning under respective environments of 35° C. in temperature and 80% in relative humidity (H/H) and 10° C. in temperature and 20% in relative humidity (L/L), thereby counting the number of printed sheets that continuously retained an image density of 1.3 or higher as measured by a reflection densitometer (manufactured by McBeth Co.) and at an unprinted area, fog of 15% or lower as determined by a whiteness meter (manufactured by Nippon Denshoku K.K.).

The fog was measured by applying a pressure-sensitive adhesive tape (Scotch Mending Tape 810-3-18, trade name; product of Sumitomo 3M Limited) to an unprinted area of a photosensitive member. Specifically, the pressure-sensitive adhesive tape was applied to the unprinted area of the photosensitive member before the printing and then peeled. This tape was applied to paper for printing to measure the whiteness degree A thereof. Similarly, the pressure-sensitive adhesive tape was applied to the unprinted area of the photosensitive member after the printing and then peeled. This tape was applied to paper for printing to measure the whiteness degree B thereof. The fog can be calculated out in accordance with the following equation:

$$\text{Fog } (\%)=[(A-B)/A]\times 100$$

The continuous printing was conducted at 5% image density. The image density and fog were determined every 500 sheets.

(9) Evaluation of Odor

In the above-described image quality evaluating test, odor in the vicinity of the exit of the printed paper was organoleptically evaluated by 5 healthy adults to count the number of persons who felt the odor of the polymerizable monomer.

Example 1

(1) Preparation of Polymerizable Monomer Composition for Core

A polymerizable monomer mixture (Tg of the copolymer obtained by copolymerizing these monomers=55° C.) for core composed of 80.5 parts of styrene and 19.5 parts of n-butyl acrylate, 0.3 parts of a polymethacrylic ester macromonomer ("AA6", trade name; Tg: 94° C.; product of Toagosei Chemical Industry Co., Ltd.), 0.5 parts of divinylbenzene, 1.2 parts of t-dodecylmercaptan, 7 parts of carbon black ("#25B", trade name; product of Mitsubishi Kagaku Co., Ltd.), 1 part of a charge control agent ("Spiron Black TRH", trade name; product of Hodogaya Chemical Co., Ltd.) and 2 parts of a parting agent ("Paraflint H1", trade name; Fischer-Tropsch wax produced by Sutherl Co.; endothermic peak temperature=100° C.) were subjected to wet grinding by means of a media type wet grinding machine to prepare a polymerizable monomer composition for core.

(2) Preparation of Aqueous Dispersion Medium

An aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to prepare a dispersion of magnesium hydroxide colloid. The particle diameter distribution of the colloid formed was measured by means of a microtrack particle diameter distribution measuring device (manufactured by Nikkiso Co., Ltd.) and found to be 0.35 μm in terms of $D_{50}$ (50% cumulative value of number particle diameter distribution) and 0.84 μm in terms of $D_{90}$ (90% cumulative value of number particle diameter distribution). The measurement by means of the microtrack particle diameter distribution measuring device was performed under the following conditions:

Measuring range: 0.12 to 704 μm;

Measuring time: 30 seconds; and

Medium: ion-exchanged water.

(3) Preparation of Dispersion of Polymerizable Monomer for Shell

Three parts of methyl methacrylate (Tg of the polymer=105° C.) and 30 parts of water were subjected to a finely dispersing treatment by an ultrasonic emulsifier to obtain an aqueous dispersion of a polymerizable monomer for shell. The droplet diameter of droplets of the polymerizable monomer for shell in the dispersion was found to be 1.6 μn in terms of $D_{90}$, as determined by means of the microtrack particle diameter distribution measuring device by adding the droplets thus obtained at a concentration of 3% to a 1% aqueous solution of sodium hexametaphosphate.

(4) Droplet-forming Step

The polymerizable monomer composition for core obtained in the step (1) was poured into the colloidal dispersion of magnesium hydroxide obtained in the step (2), and the mixture was stirred until droplets became stable. After 6 parts of t-butyl peroxy-2-ethylhexanoate ("Perbutyl O", trade name, product of Nippon Oil & Fats Co., Ltd.) were added as a polymerization initiator thereto, the resultant dispersion was stirred 30 minutes at 15,000 rpm under high shearing force by means of an Ebara Milder (MDM303 Model, manufactured by Ebara Corporation) to form droplets of the polymerizable monomer composition.

(5) Suspension Polymerization Step

A reactor equipped with a stirrer was charged with the aqueous dispersion containing the droplets of the polymerizable monomer composition prepared in the step (4) to initiate a polymerization reaction at 85° C. After a conversion into a polymer reached almost 100%, a dispersion of the aqueous dispersion of the polymerizable monomer for shell prepared in the step (3), in which 0.3 parts of a water-soluble initiator [2,2'-azobis(2-methyl-N-(2-hydroxyethyl)-propionamide); "VA-086", trade name; product of Wako Pure Chemical Industries, Ltd.] had been dissolved, was charged into the reactor. After the reaction was continued for 4 hours, the reaction was stopped to obtain a dispersion (slurry) containing polymer particles formed.

(6) Stripping Treatment Under Reduced Pressure

An evaporation tank equipped with a stirrer was charged with the slurry containing the polymer particles obtained in the step (5). While stirring the slurry, a part thereof was sent into a plate type external heat exchanger, and the slurry heated there was circulated within the evaporation tank. This process was repeated. Specifically, while stirring the slurry and circulating it within the system, the slurry was heated to a temperature of 60° C. At this time, the slurry was circulated by adopting a method that the slurry heated by the plate type external heat exchanger is returned to the evaporation tank by injecting (flashing) it toward the liquid level within the evaporation tank from the top of the evaporation tank.

Thereafter, the pressure within the evaporation tank was reduced to 230 Torr. Further, the slurry was heated to raise the temperatures of the slurry within the evaporation tank and the slurry at the exit of the external heat exchanger to 70° C. and 80° C., respectively. While retaining these conditions and continuously adding ion-exchanged water in an amount corresponding to the amount of water distilled off within the system, the stripping treatment under reduced pressure was continued. After conducting the stripping treatment under reduced pressure for 5 hours, the pressure reduced was returned back, and the slurry was cooled to 25° C. After the stripping treatment under reduced pressure, neither increase of aggregate in the slurry nor adhesion of scale to the interiors of the evaporation tank and the external heat exchanger was observed.

(7) Recovery Step

After the stripping treatment under reduced pressure in the step (6), the slurry cooled was washed (at 25° C. for 10 minutes) with sulfuric acid under stirring to adjust the pH to 4.5 or lower. This slurry was then filtered, and dewatered by means of a continuous belt filter ("Eagle Filter" trade name, manufactured by Sumitomo Heavy Industries, Ltd.) and washed by spraying washing water, and solids were than separated by filtration. By the separation by filtration, wet polymer particles were obtained. The wet polymer particles were placed in a dryer to dry them at 45° C. for 10 hours to recover core.shell type polymer particles. The contents of the residual polymerizable monomers in the wet polymer particles and the polymer particles after the drying were measured.

(8) Preparation of Developer

To 100 parts of the polymer particles obtained in the step (7) were added 0.8 parts of silica ("RX200", trade name; product of Nippon Aerosil Co., Ltd.) having an average particle diameter of 14 nm subjected to a hydrophobicity-imparting treatment, and they were mixed by means of a Henschel mixer to prepare a non-magnetic one-component developer (toner). With respect to the toner thus obtained, evaluation was made as to image quality. The results are shown in Table 1.

Example 2

A toner was obtained in the same manner as in Example 1 except that the time of the stripping treatment under reduced pressure in the step (6) of the stripping treatment under reduced pressure in Example 1 was changed from 5 hours to 10 hours.

After the stripping treatment under reduced pressure, neither increase of aggregate in the slurry nor adhesion of scale to the interiors of the evaporation tank and the external heat exchanger was observed. The results are shown in Table 1.

Example 3

(1) Preparation of Polymerizable Monomer Composition for Core

A polymerizable monomer mixture (Tg of the copolymer obtained by copolymerizing these monomers=48° C.) for core composed of 77 parts of styrene and 23 parts of n-butyl acrylate, 7 parts of carbon black ("#25B", trade name; product of Mitsubishi Kagaku Co., Ltd.), 1 part of a 2-acrylamide-2-methylpropanesulfonic acid-containing copolymer [Mw=21,000; styrene/n-butyl acrylate/2-acrylamide-2-methylpropanesulfonic acid copolymer (copolymerization ratio=87/10/3) (%)], 0.3 parts of divinylbenzene and 0.5 parts of a polymethacrylic ester macromonomer ("AA6", trade name; Tg: 94° C.; product of Toagosei Chemical Industry Co., Ltd.) were stirred and mixed by an ordinary stirring device and then uniformly dispersed by a media type dispersing machine. To the dispersion thus obtained, 10 parts of pentaerythritol tetramyristate were added and mixed into a solution, thereby preparing a polymerizable monomer composition for core.

(2) Preparation of Aqueous Dispersion Medium

A dispersion of magnesium hydroxide colloid was prepared in the same manner as in Example 1 except that in the step (2) of preparing the aqueous dispersion medium in Example 1, the amounts of magnesium chloride and sodium hydroxide were changed from 10.2 parts and 6.2 parts to 9.5 parts and 5.8 parts, respectively. The particle diameter distribution of the colloid formed was measured by means of a microtrack particle diameter distribution measuring device (manufactured by Nikkiso Co., Ltd.) and found to be 0.36 $\mu$m in terms of $D_{50}$ (50% cumulative value of number particle diameter distribution) and 0.80 $\mu$m in terms of $D_{90}$ (90% cumulative value of number particle diameter distribution).

(3) Preparation of Dispersion of Polymerizable Monomer for Shell

Three parts of methyl methacrylate and 30 parts of water were subjected to a finely dispersing treatment by an ultrasonic emulsifier to obtain an aqueous dispersion of a polymerizable monomer for shell. The droplet diameter of droplets of the polymerizable monomer for shell in the dispersion was found to be 1.6 $\mu$m in terms of $D_{90}$ as determined by means of the microtrack particle diameter distribution measuring device by adding the droplets thus obtained at a concentration of 3% to a 1% aqueous solution of sodium hexametaphosphate.

(4) Droplet-forming Step

The polymerizable monomer composition for core obtained in the step (1) was poured into the colloidal dispersion of magnesium hydroxide obtained in the step (2), and the mixture was stirred until droplets became stable. After 6 parts of t-butyl peroxy-2-ethylhexanoate ("Perbutyl O", trade name, product of Nippon Oil & Fats Co., Ltd.) were added as a polymerization initiator thereto, the resultant dispersion was stirred 30 minutes at 15,000 rpm under high shearing force by means of an Ebara Milder (MDM303V Model, manufactured by Ebara Corporation) to form droplets of the polymerizable monomer composition.

(5) Suspension Polymerization Step

A reactor equipped with a stirrer was charged with the aqueous dispersion containing the droplets of the polymerizable monomer composition prepared in the step (4) to initiate a polymerization reaction at 85° C. After a conversion into a polymer reached almost 100%, a dispersion obtained by adding 0.3 parts of ammonium persulfate as a water-soluble initiator dissolved in 65 parts of distilled water to the aqueous dispersion of the polymerizable monomer for shell prepared in the step (3) was charged into the reactor. After the reaction was continued for 4 hours, the reaction was stopped to obtain a dispersion (slurry) containing polymer particles formed.

(6) Stripping Treatment Under Reduced Pressure

A stripping treatment under reduced pressure was conducted in the same manner as in Example 1 except that in the step (6) of the stripping treatment under reduced pressure in Example 1, the stripping conditions were changed from 230 Torr to 160 Torr for vacuumization within the evaporation tank, from 70° C. to 60° C. for the slurry temperature within the evaporation tank, and from 80° C. to 70° C. for the slurry temperature at the exit of the heat exchanger, respectively.

After the stripping treatment under reduced pressure, neither increase of aggregate in the slurry nor adhesion of scale to the interiors of the evaporation tank and the external heat exchanger was observed.

(7) Recovery Step

Core.shell type polymer particles were recovered in the same manner as in Example 1 except that in the recovery step (7) of Example 1, the pH of the system upon the acid washing and the drying time were changed from 4.5 to at most 4, and 10 hours to a day, respectively. The contents of the residual polymerizable monomers in the wet polymer particles and the polymer particles after the drying were measured.

(8) Preparation of Developer

To 100 parts of the polymer particles obtained in the step (7) were added 0.6 parts of colloidal silica ("RX200", trade name; product of Nippon Aerosil Co., Ltd.) subjected to a hydrophobicity-imparting treatment, and they were mixed by means of a Henschel mixer to prepare a non-magnetic one-component developer (toner). The results are shown in Table 1.

Example 4

A toner was obtained in the same manner as in Example 3 except that the time of the stripping treatment under reduced pressure in the step (6) of the stripping treatment under reduced pressure in Example 1 was changed from 5 hours to 10 hours.

After the stripping treatment under reduced pressure, neither increase of aggregate in the slurry nor adhesion of scale to the interiors of the evaporation tank and the external heat exchanger was observed. The results are shown in Table 1.

Comparative Example 1

A toner was obtained in the same manner as in Example 1 except that no stripping treatment under reduced pressure was performed. The polymer particles thus obtained had Tg of 55° C., a volume average particle diameter of 7.2 μm and a particle diameter distribution as narrow as 1.25. However, the polymer particles has a residual styrene content of 360 ppm, a residual n-butyl acrylate content of 102 ppm and a residual methyl methacrylate content of 56 ppm (518 ppm in total), and all the 5 persons felt odor in the evaluation as to odor. The results are shown in Table 1.

Comparative Example 2

A toner was obtained in the same manner as in Example 3 except that no stripping treatment under reduced pressure was performed. The polymer particles thus obtained had a volume average particle diameter of 6.9 μm and a particle diameter distribution as narrow as 1.24. However, the polymer particles has a residual styrene content of 205 ppm, a residual n-butyl acrylate content of 78 ppm and a residual methyl methacrylate content of 42 ppm (325 ppm in total), and 3 persons of the 5 persons felt odor in the evaluation as to odor. The results are shown in Table 1.

TABLE 1

| | Example | | | | Comp. Ex. | |
|---|---|---|---|---|---|---|
| | 1 | 2 | 3 | 4 | 1 | 2 |
| Stripping under reduced pressure | | | | | | |
| Temperature (° C.) | 70 | 70 | 60 | 60 | — | — |
| Pressure (Torr) | 230 | 230 | 160 | 160 | — | — |
| Time hr) | 5 | 10 | 5 | 10 | — | — |
| Polymerized toner | | | | | | |
| Dv (μm) | 7.1 | 6.8 | 7.3 | 7.1 | 7.2 | 6.9 |
| Dv/Dn | 1.30 | 1.32 | 1.26 | 1.26 | 1.25 | 1.24 |
| Spheroidicity (Sc/Sr) | 1.1 | 1.2 | 1.2 | 1.1 | 1.2 | 1.1 |
| Tg (° C.) | 55 | 56 | 48 | 48 | 55 | 48 |
| Flowability (%) | 65 | 68 | 63 | 62 | 48 | 42 |
| Residual metal content (ppm) | 78 | 100 | 96 | 81 | 140 | 90 |
| Melt viscosity (poise) | 6.5x $10^4$ | 7.0x $10^4$ | 5.7x $10^4$ | 6.6x $10^4$ | 7.1x $10^4$ | 6.5x $10^4$ |
| Residual monomer content (ppm) | | | | | | |
| Before drying | | | | | | |
| ST | 76 | 39 | 148 | 78 | — | — |
| BA | 0 | 0 | 0 | 0 | — | — |
| MMA | 0 | 0 | 0 | 0 | — | — |
| After drying | | | | | | |
| ST | 45 | 25 | 68 | 46 | 360 | 205 |
| BA | 0 | 0 | 0 | 0 | 102 | 78 |
| MMA | 0 | 0 | 0 | 0 | 56 | 42 |
| Evaluation as to image quality | | | | | | |
| H/H (sheet) | 12000 | 11000 | 10000 | 12000 | 9000 | 9000 |
| L/L (sheet) | 13000 | 13000 | 11000 | 13000 | 10000 | 10000 |
| Odor (number of persons/5 persons) | 0/5 | 0/5 | 0/5 | 0/5 | 5/5 | 3/5 |

(Note)
(1) ST: Styrene
(2) BA: n-Butyl acrylate
(3) MMA: Methyl methacrylate
(4) dv: Volume average particle diameter
(5) dv/dn: Particle diameter distribution
(6) H/H: under environment of 35° C./80% RH
(7) L/L: under environment of 10° C./20% RH.

As apparent from the above-described results, by the stripping treatment under reduced pressure, the residual polymerizable monomers can be efficiently removed without aggregating polymer particles, and moreover polymer particles (polymerized toner) excellent in flowability can be provided.

INDUSTRIAL APPLICABILITY

The toners for development of electrostatic images according to the present invention are extremely low in the content of residual polymerizable monomers and hence far excellent in environmental safety. According to the production process of a toner for development of electrostatic images of the present invention, even toners low in glass transition temperature (particularly, Tg of core particles) and melt viscosity and capable of meeting the requirements such as low-temperature fixing ability, high-speed printing ability and provision of full-color images can be recovered as toners free of occurrence of aggregation and excellent in flowability.

What is claimed is:

1. A toner for development of electrostatic images, comprising at least a binder resin and a colorant, wherein (A) the content of residual polymerizable monomers in the toner is lower than 70 ppm, (B) the toner is substantially spherical wherein the spheroidicity of the toner is 1.0 to 1.3, and (C) the flowability of the toner is at least 55%.

2. The toner for development of electrostatic images according to claim 1, wherein the content of the residual polymerizable monomers is lower than 50 ppm.

3. The toner for development of electrostatic images according to claim 1, wherein the lowest glass transition temperature of the binder resin is at most 60° C.

4. The toner for development of electrostatic images according to claim 1, wherein the melt viscosity of the toner is at most $1.0\times10^5$ poises as measured at 120° C.

5. The toner for development of electrostatic images according to claim 1, wherein the content of residual metals is at most 170 ppm.

6. The toner for development of electrostatic images according to claim 5, wherein the residual metals are magnesium or calcium.

7. The toner for development of electrostatic images according to claim 1, which is composed of polymer particles containing the colorant.

8. The toner for development of electrostatic images according to claim 1, which is composed of core.shell type polymer particles comprising core particles formed of polymer particles containing the colorant and a polymer layer covering each of the core particles formed thereon.

9. The toner for development of electrostatic images according to claim 1, wherein the volume average particle diameter of the toner is 5 to 8 $\mu$m.

10. The toner for development of electrostatic images according to claim 1, wherein the product (A×dn×D) of the BET specific surface area (A) ($m^2/g$), the number average particle diameter (dn) ($\mu$m) and the true specific gravity (D) of the toner, is 5 to 10.

11. The toner for development of electrostatic images according to claim 1, wherein the melt viscosity of the toner is $1.0\times10^4$ to $8.0\times10^4$ poises as measured at 120° C.

12. A process for producing a toner for development of electrostatic images, comprising the step of subjecting a polymerizable monomer composition containing at least a colorant and a polymerizable monomer to suspension polymerization in an aqueous dispersion medium containing a dispersion stabilizer, the process comprising the steps of:

(1) forming polymer particles by suspension polymerization, thereby obtaining a slurry containing the polymer particles, (2) subjecting the slurry to a stripping treatment under conditions of reduced pressure to distill off volatile components including the aqueous dispersion medium and the polymerizable monomer, and (3) recovering the polymer particles from the remaining slurry, wherein in the recovery step (3), polymer particles, which have a residual polymerizable monomer content lower than 70 ppm and flowability of at least 55% and which are substantially spherical, wherein the spheroidicity of the particles is 1.0 to 1.3, are recovered after dewatering, washing and driving.

13. The process according to claim 12 for producing the toner for development of electrostatic images, wherein in the step (2) of the stripping treatment under reduced pressure, the stripping treatment under reduced pressure is conducted while controlling the temperature of the slurry in such a manner that the temperature Ts (°C.) of the slurry and the lowest glass transition temperature Tg (°C.) of the polymer component in the polymer particles satisfy the following relationship (I):

$$Tg \leqq Ts < 100\ (^\circ\mathrm{C.}) \qquad \text{(I).}$$

14. The process according to claim 12 for producing the toner for development of electrostatic images, wherein in the step (2) of the stripping treatment under reduced pressure, the pressure is controlled to 50 to 500 Torr to conduct the stripping treatment under reduced pressure.

15. The process according to claim 12 for producing the toner for development of electrostatic images, wherein in the step (2) of the stripping treatment under reduced pressure, the stripping treatment under reduced pressure is conducted for 0.5 to 50 hours.

16. The process according to claim 12 for producing the toner for development of electrostatic images, wherein in the step (2) of the stripping treatment under reduced pressure, the stripping treatment under reduced pressure is conducted while distilling off volatile components including the aqueous dispersion medium and the polymerizable monomer and adding an aqueous dispersion medium to the slurry.

17. The process according to claim 16 for producing the toner for development of electrostatic images, wherein the amount of the aqueous dispersion medium added to the slurry is an amount almost corresponding to the amount of the aqueous dispersion medium distilled off by the stripping treatment under reduced pressure.

18. The process according to claim 12 for producing the toner for development of electrostatic images, wherein in the step (2) of the stripping treatment under reduced pressure, the stripping treatment under reduced pressure is conducted while circulating the slurry between an evaporation tank and an external heat exchanger, and the slurry is returned into the bottom the evaporation tank while flashing the slurry heated by means of the external heat exchanger from the top of the evaporation tank.

19. The process according to claim 12 for producing the toner for development of electrostatic images, wherein in the suspension polymerization step (1), a polymerizable monomer composition containing at least a colorant and a polymerizable monomer is subjected to suspension polymerization to form colored polymer particles containing the colorant.

20. The process according to claim 12 for producing the toner for development of electrostatic images, wherein in the suspension polymerization step (1), a polymerizable monomer composition containing at least a colorant and a polymerizable monomer is subjected to suspension polymerization to form colored polymer particles containing the colorant, and a polymerizable monomer capable of forming a polymer having a glass transition temperature higher than that of the polymer component making up the colored polymer particles is polymerized in the presence of the colored polymer particles, thereby forming core.shell type polymer particles that a polymer layer covering each of the colored polymer particles has been formed.

21. The process according to claim 20 for producing the toner for development of electrostatic images, which comprises forming core.shell type polymer particles that the glass transition temperature of the polymer component making up the colored polymer particles is at most 60° C., and the glass transition temperature of the polymer component making up the polymer layer is higher by at least 10° C. than that of the polymer component making up the colored polymer particles.

22. The process according to claim 12 for producing the toner for development of electrostatic images, wherein in the recovering step (3), polymer particles having a melt viscosity of at most $1.0\times10^5$ poises as measured at 120° C. are recovered after dewatering, washing and drying.

* * * * *